US006971778B2

(12) United States Patent
Peitz et al.

(10) Patent No.: US 6,971,778 B2
(45) Date of Patent: Dec. 6, 2005

(54) HEADLIGHT FOR VEHICLES

(75) Inventors: Wolfgang Peitz, Warstein (DE); Dirk Schwemin, Lippstadt (DE)

(73) Assignee: Hella KG Hueck & Co., Lippstadt (DE)

( * ) Notice: Subject to any disclaimer, the term of this patent is extended or adjusted under 35 U.S.C. 154(b) by 46 days.

(21) Appl. No.: 10/792,826

(22) Filed: Mar. 5, 2004

(65) Prior Publication Data

US 2004/0174714 A1 Sep. 9, 2004

(30) Foreign Application Priority Data

Mar. 5, 2003 (DE) ..... 103 09 434

(51) Int. Cl.[7] ..... F21V 5/00
(52) U.S. Cl. ..... 362/522; 362/539; 362/309; 362/343
(58) Field of Search ..... 362/520–522, 362/538, 539, 308, 309, 343

(56) References Cited

U.S. PATENT DOCUMENTS 4,180,849 A * 12/1979 Parkin ..... 362/522
4,796,171 A 1/1989 Lindae et al.
5,014,173 A 5/1991 Lindae et al.
5,036,438 A * 7/1991 Nakata ..... 362/539

FOREIGN PATENT DOCUMENTS

DE 3602262 A1 5/1987
DE 90 00 395.0 U1 6/1991
DE 4031352 A1 4/1992

* cited by examiner

*Primary Examiner*—Stephen F Husar
(74) *Attorney, Agent, or Firm*—Birch, Stewart, Kolasch & Birch, LLP

(57) ABSTRACT

A headlight for vehicles with a projection module is provided, which includes a bowl-shaped reflector, an illumination unit dedicated to the reflector, a lens, and a shutter arranged between the lens and the reflector. The shutter forms a light-dark-border of a light bundle. The lens features a convex front side facing away from the reflector and an optical element mounted to the headlight in the lower middle margin area on the front. The light beams emerging from the optical element are directed to an area above the light-dark-border of the light bundle of the headlight. In vertical second planar sections, to which the optical axis of the projection module extends perpendicularly, the surface of the optical element is concave-shaped, and in vertical planar sections extending parallel to the optical axis, it is convex-shaped.

13 Claims, 4 Drawing Sheets

HEADLIGHT FOR VEHICLES

This nonprovisional application claims priority under 35 U.S.C. § 119(a) on German Patent Application No. DE 103 09 434.2 filed in Germany on Mar. 5, 2003, which is herein incorporated by reference.

BACKGROUND OF THE INVENTION

1. Field of the Invention

The present invention relates to a headlight for vehicles with a projection module including a bowl-shaped reflector, an illumination unit that is provided for the bowl-shaped reflector, a lens, and a shutter arranged between the lens and the reflector, whereby the shutter forms a light-dark-border of a light bundle of the headlight, the lens has a convex front side that faces away from the bowl-shaped reflector, an optical element on the convex front side of the lens is arranged in a lower middle margin area, and light beams emerging from the optical element are directed to an area above the light-dark border of the light bundle of the headlight.

2. Description of the Background Art

From DE-U-90 00 395 a headlight for vehicles is known, whereby a projection module for a fog light is arranged in a housing behind a closure pane. To manipulate the light distribution of the light bundle, the closure pane is provided with a cylinder optic, and the lens, in its middle lower margin area on a convex front side, is provided with an optical element, which has a cylinder optic extending in a horizontal direction. The cylinder optic borders, in a downward direction, a convex segment of the front of the lens that is receded in the direction of the optical axis to the reflector. The cylinder optic of the lens deflects a part of the light in a certain angle area upwards. Thus, the light values above the light-dark-border increase so that the legal rules for fog lights are followed. Because the horizontal cylinder optic of the lens has a relatively great distance from the lower margin of the lens, the driver's vision field is inhomogeneously (non-uniformly) illuminated. Furthermore, the width of the band of light created by the horizontal cylinder optic above the light-dark-border is variable in height only by an arrangement of the horizontal cylinder optic. The higher that the cylinder optic is arranged, the more distracting the resulting inhomogeneous light distribution is.

SUMMARY OF THE INVENTION

It is therefore an object of the present invention to provide a headlight for vehicles so that an optical element of a lens creates neither an inhomogeneous light distribution for a shuttered light bundle nor an irritating elevation on a convex front side of the lens. According to the invention, this is accomplished in that continuously or in sections staggered in relation to each other, the surface of the optical element is concave-shaped in vertical second planar sections, to which the optical axis of the projection module extends perpendicular, and is convex-shaped in vertical first planar sections extending parallel to the optical axis.

With a lens with an original full-surface convex front side, the light beams emerging from the optical element would illuminate a very limited area in front of the vehicle, which for the driver would be hidden by the body of the vehicle. With segments of the surface of the lens staggered in relation to each other, e.g., the segments being arranged stepwise to one another, the light beams would illuminate a larger area, thereby providing an increased illumination area for the driver.

Additionally, it is beneficial if the concave-shaped, that is, the convex-shaped surface of the optical element extends all the way to the convex front side of the lens and is bordered towards the convex front side of the lens by an edge, and the surface of the lens, which is convex-shaped in the first planar sections, is bordered by a bent first line section, which in its course has a respective bent third line section, which is located on the original lens on the original full-surface convex front side in a middle vertical planar section in the lower margin area. This provides a light distribution above the light-dark-border with precise borders towards the top and to the sides, and no transitional surfaces between the convex front side of the lens and the optical element are needed.

A particular advantage of the invention is that the bent third line section on the original full-surface convex front side of the lens and the bent first line section of the optical element have a mutual center of rotation above the optical element, whereby the first line section of the optical element opposite the line section of the original full-surface convex front side of the lens is pivoted around the center of rotation towards the reflector by an angle. The angle determines the amount of the deflection of the upwardly-directed light beams.

The band of light created by the optical element and light figure of the light-dark-border intertwine one another, when there is an angle of between 5 degrees and 8 degrees preferably 6.5 degrees, between the bent third line section of the original full-surface convex front side of the lens and the bent first line section of the optical element.

In a preferred embodiment, the convex-shaped surface of the lens in the, horizontal planar sections is bordered by bent second line sections of a circular line. The larger the circle, the smaller the light deflection to the sides is.

A high-powered illumination unit, for example, a xenon lamp, requires a smaller optical element than a low-powered illumination unit like, for example, a halogen lamp. In both cases, the size of the light band created by the light beams is approximately the same.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limited of the present invention, and wherein.

DETAILED DESCRIPTION

Figure 1:
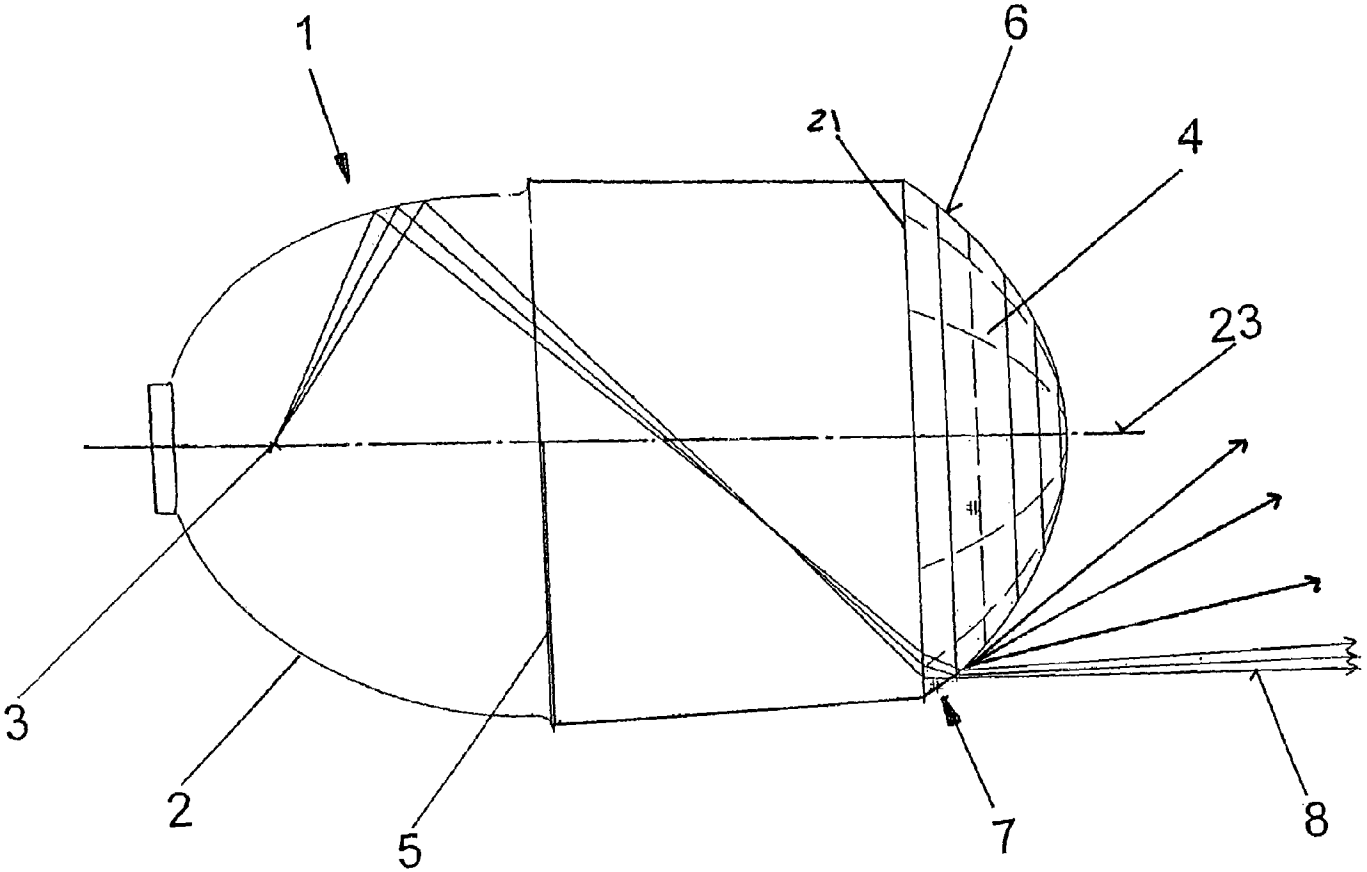
FIG. 1 shows a middle vertical longitudinal section of a projection module for a headlight of a vehicle in low-beam mode.
Figure 4:
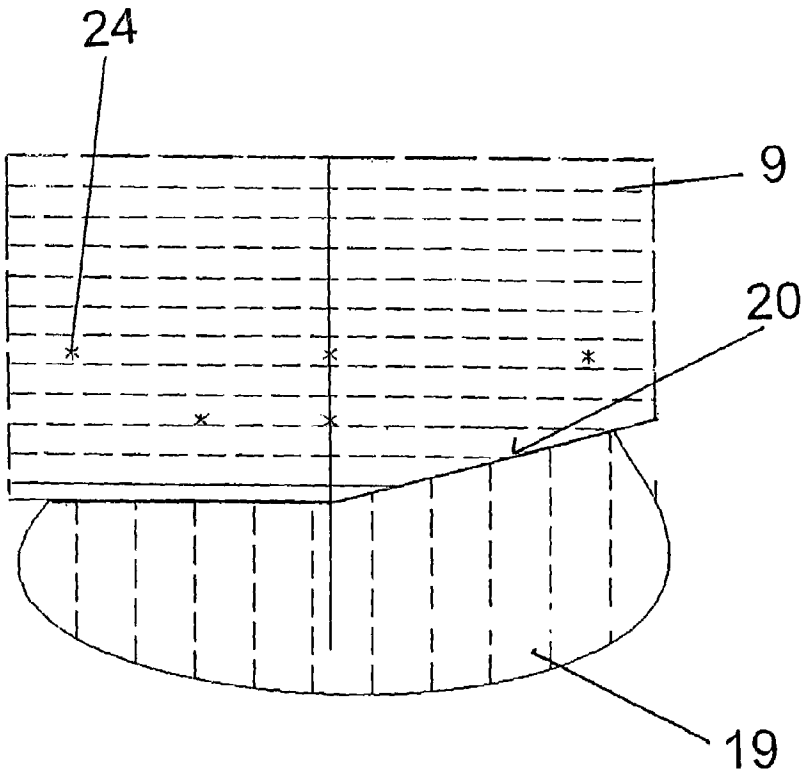
FIG. 4 is a light figure illustrating a light bundle showing a light-dark border, and an illuminated area above the light bundle.
Figure 2:
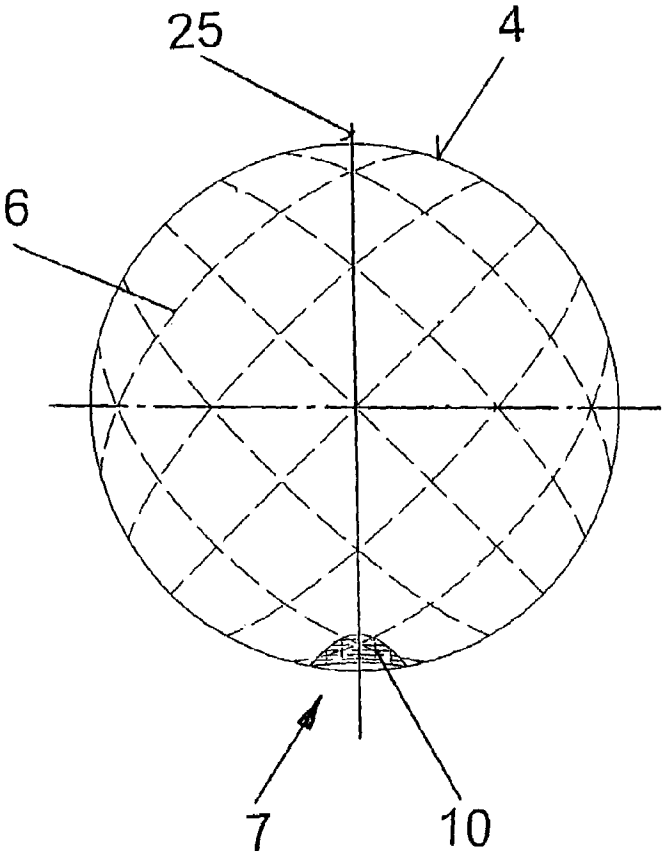
FIG. 2 is a single-component front view of a lens of the projection module.
Figure 5:
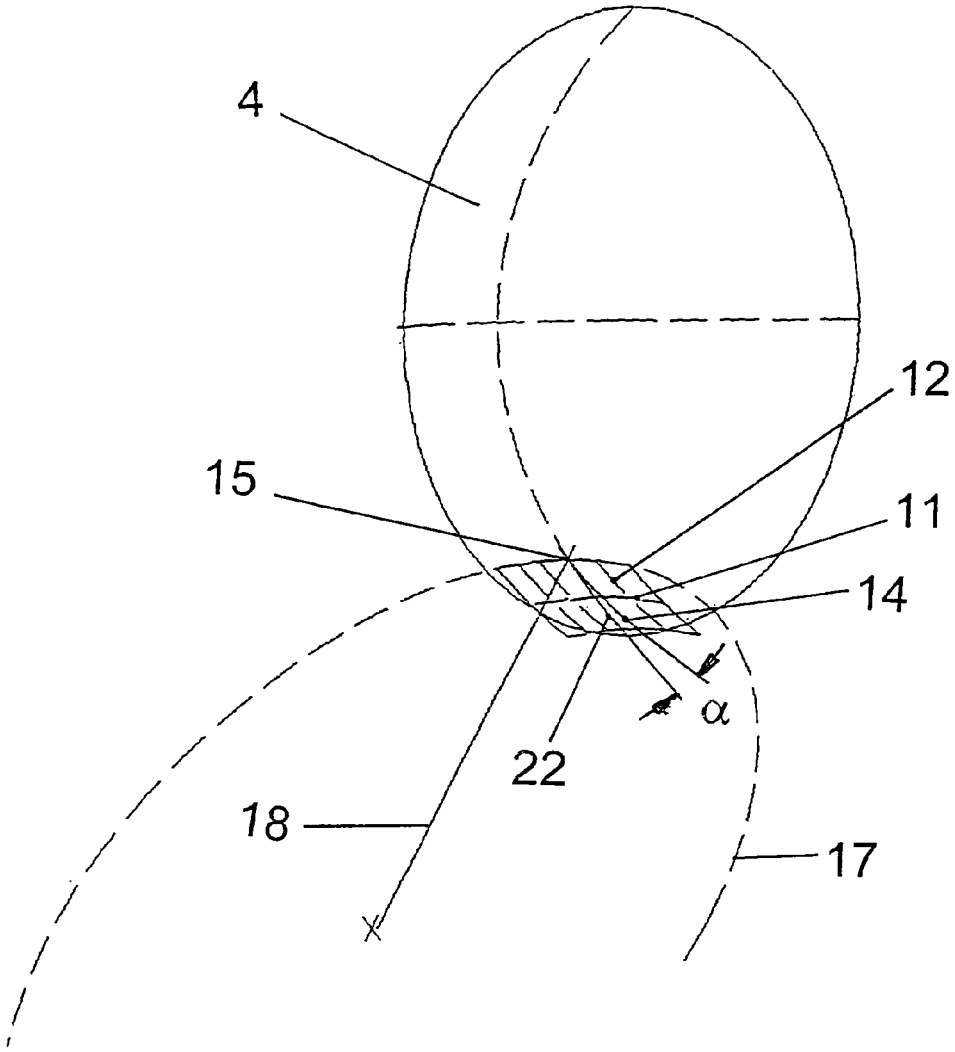
FIG. 5 is a perspective view of a lens with an area, where the surface of the optical element is located.
Figure 3:
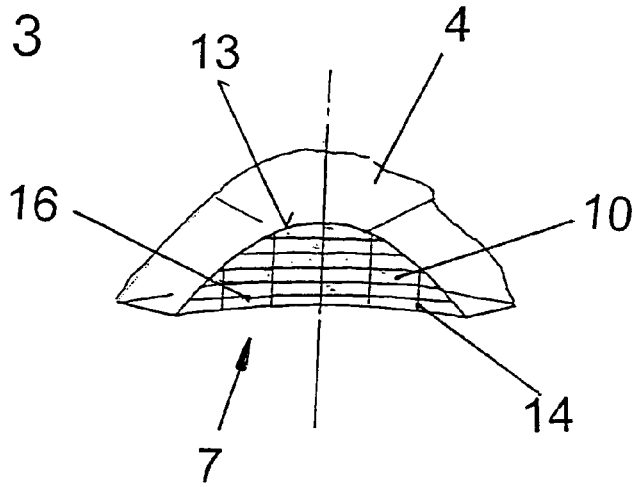
FIG. 3 is a sectional view of an optical element of the lens.

A headlight for a vehicle has a projection module 1, which includes an elliptical reflector 2, an illumination unit 3 that is dedicated to the reflector 2, a lens 4, and a shutter 5 arranged between the lens 4 and the reflector 2. The shutter 5, together with a shutter edge, forms a light-dark-border 20 of an asymmetrical light bundle 19. In FIG. 4, the light bundle 19 is shown as part of a light figure projected onto a vertical wall located at a distance from the front of the vehicle.

The lens 4 features a planar back side 21 facing towards the reflector 2, and a convex front side 6. On the convex front side 6, in the lower middle margin area of lens 4, an optical element 7 is provided. The optical element 7 has a surface 10, which is symmetrical with a vertical middle planar section 25 of the lens 4, into which an optical axis 23 extends.

In all vertical first planar sections 12, which extend parallel to the optical axis 23, the surface 10 of the optical element 7 features convex first line sections 14, which are identical to a third line section 22, which is located on the convex front side 6 of the lens 4 and in the vertical middle planar section 25 of the lens 4 in the lower margin area of lens 4. The third line section 22 is pivoted by an angle $\alpha$ of, for example, 6.5 degrees towards the rear of the lens 4 and thus creates the first line section 14 of the surface 10 of the optical element 7 and extends in the vertical middle section of the lens 4.

In all vertical second planar sections 11 extending substantially parallel to the planar backside 21 of the lens 4, the surface 10 of the optical element 7 is concave-shaped and features second line sections 16 in all second planar sections 11. The second line sections 16 lie on a circular line 17, the radius 18 of which is smaller than that of lens 4. The surface 10 of the optical element 7 is bordered towards the convex front side 6 of the lens 4 by a sharp edge 13. Light beams 8, which are reflected by the reflector 8 and pass through the optical element 7, are directed towards an area 9, which, for at least most of its area, is arranged above the light-dark-border of the light bundle 19. In FIG. 4, several light measuring points 24 as prescribed by law are indicated.

Figure 6:
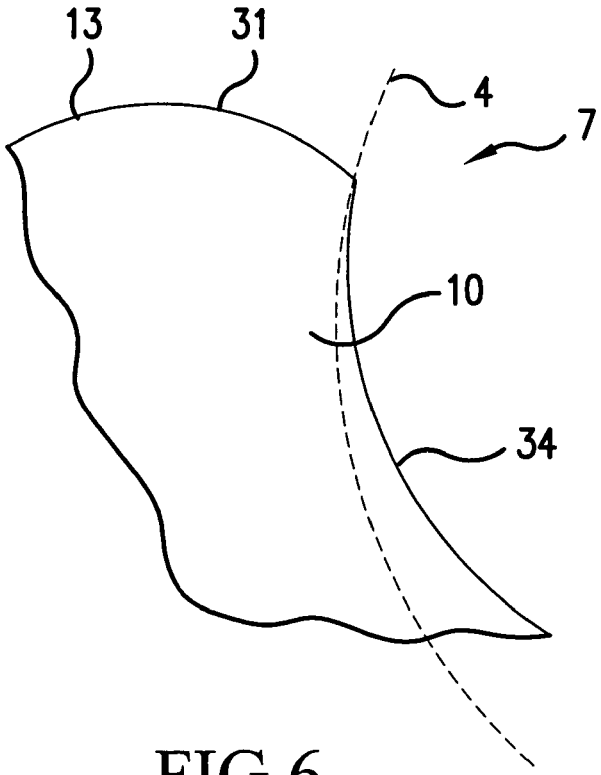
FIG. 6 is a partial perspective view of the optical element according to a preferred embodiment of the invention.
Figure 7:
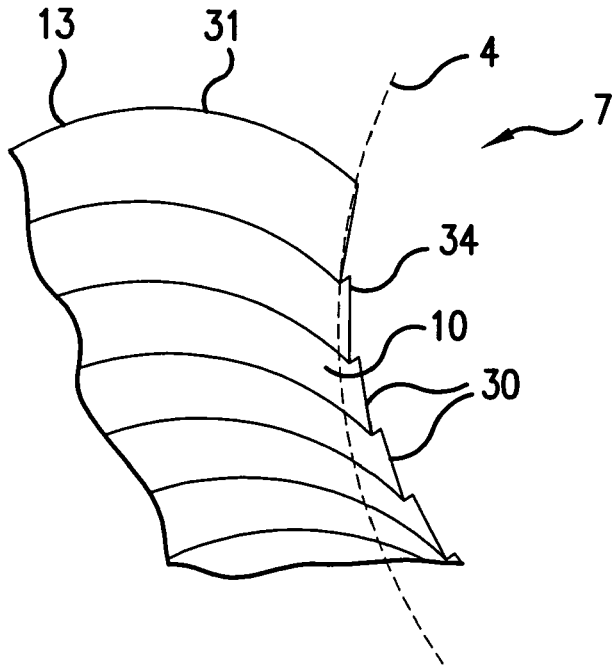
FIG. 7 is a partial perspective view of the optical element according to an alternate aspect of the invention.

Referring to FIGS. 6 and 7, there is shown a partial perspective view of the optical element 7. FIG. 6 shows the surface 10 of the optical element 7 being continuous and FIG. 7 shows the surface 10 of the optical element 7 being formed of staggered sections 30. The optical element 7 and the lens 4 are preferably formed as one-piece by, for example, injection molding. FIGS. 6 and 7 also show that the surface 10 of the optical element 7 forms a concave border 31 between the lens 4 and the optical element 7 at the edge 13, and that a convex border 34 is formed between surface 10 of the optical element 7 and the lens 4.

The invention being thus described, it will be obvious that the same may be varied in many ways. Such variations and not to be, regarded as a departure from the spirit and scope of the invention, and all such modifications as would be obvious to one skilled in the art are to be included within the scope of the following claims.

What is claimed is:

1. A projection module for a headlight of a vehicle, the projection module comprising:

a bowl-shaped reflector;

an illumination unit that is provided for the reflector;

a lens having a convex front side that faces away from the reflector; and a shutter being arranged between the lens and the reflector, the shutter forming a light-dark boundary of a light bundle that is projected from the headlight; and an optical element being formed on the convex front side of the lens and being arranged in a lower middle margin area, wherein light beams emerging from the optical element are directed to an area above the light-dark boundary of the light bundle of the headlight, and wherein the surface of the optical element includes convex-shaped vertical first planar sections that extend parallel to an optical axis of the projection module and concave-shaped vertical second planar sections that extend perpendicular to the optical axis of the projection module.

2. The headlight according to claim 1, wherein the concave-shaped surface of the optical element extends substantially towards the convex front side of the lens and is bordered by an edge on the convex front side of the lens.

3. The headlight according to claim 1, wherein the surface of the lens, which is convex-shaped in the first planar sections, is bordered by a bent first line section, which corresponds to a bent third line section, which is featured by the original lens on an original full-surface convex front side in a middle vertical planar section in the lower margin area.

4. The headlight according to claim 3, wherein the bent third line section on the original full-surface convex front side of the lens and the bent first line section of the optical element have a mutual center of rotation above the optical element, whereby the first line section of the optical element that is opposite from the line section of the original full-surface convex front of the lens is pivoted around the center of rotation towards the reflector by an angle.

5. The headlight according to claim 4, wherein between the bent third line section of the original full-surface convex front side of the lens and the bent first line section of the optical element, there is an angle between 5 degrees and 8 degrees.

6. The headlight according to claim 1, wherein the surface of the lens, which is concave-shaped in the second planar sections, is bordered by bent second line sections of a circular line.

7. The headlight according to claim 6, wherein the circle forming the line section has a smaller radius than the lens.

8. The headlight according to claim 1, wherein the surface of the optical element is formed to be continuous or staggered in sections in relation to each other.

9. The headlight according to claim 5, wherein the angle is 6.5 degrees.

10. A projection module comprising:

a reflector for reflecting and directing light beams;

a lens having a convex surface in an emission path of the light beams; and an optical element being integrally formed in a lower portion of the convex surface of the lens for directing the light beams reflected thereto by the reflector, the optical element having a surface being concave in a first direction and convex in a second direction, the first direction and second direction being perpendicular to one another.

11. The projection module according to claim 10, wherein the surface of the optical element is formed of staggered sections, which are staggered in the second direction.

12. The projection module according to claim 10, wherein the optical element directs a portion the light beams that are reflected to the optical element by the reflector so as to intersect the light beams traveling along the emission path.

13. The projection module according to claim 10, wherein the first direction is horizontal and the second direction is vertical with respect the convex surface of the lens.

* * * * *